United States Patent [19]

Groves, Sr. et al.

[11] 4,125,162

[45] Nov. 14, 1978

[54] WELL FLOW SYSTEM AND METHOD

[75] Inventors: David L. Groves, Sr., Houma, La.; Olen R. Long, Celina, Tex.; Billy G. McCoy, Houma, La.

[73] Assignee: Otis Engineering Corporation, Dallas, Tex.

[21] Appl. No.: 796,619

[22] Filed: May 13, 1977

[51] Int. Cl.[2] ..... E21B 19/00; E21B 43/00

[52] U.S. Cl. ..... 166/314; 166/75 R; 254/134.4; 214/1 P; 166/362; 166/368

[58] Field of Search ..... 166/314, 315, 0.5, 75, 166/77, 89, 70; 137/15; 138/97–99; 254/134.4; 214/1 P; 61/72.1, 72.3

[56] References Cited

U.S. PATENT DOCUMENTS

| | | | |
|---|---|---|---|
| 3,239,004 | 3/1966 | Coberly | 166/75 X |
| 3,346,045 | 10/1967 | Knapp et al. | 166/0.5 |
| 3,472,032 | 10/1969 | Howard | 166/0.5 X |
| 3,642,070 | 2/1972 | Taylor et al. | 166/314 |

*Primary Examiner*—Stephen J. Novosad
*Attorney, Agent, or Firm*—H. Mathews Garland

[57] ABSTRACT

A well system and method of installation and operation for two-way communication between a service facility and a remotely located well head such as associated with an offshore well for such well functions as production of well fluids by gas lift. The system includes a well having a string of production tubing in a casing defining an annulus around the tubing, a gas lift valve in the tubing to admit lift gas from the annulus to the bore of the tubing to assist in raising production fluids to the surface, a well head including fittings for fluid communication into the production tubing and into the annulus, a service facility spaced from the well head including facilities for receiving well production and for pumping injection gas for gas lift in the well, and conductors communicating the service facility with the well head. The coiled tubing string is installed in the flow line between the service facility and the well head by several techniques including using pumpdown pistons which are displaced through the flow line by fluid pressure from the service facility to the well head. The pumpdown pistons may be either connected directly to the coiled tubing to pull the tubing from the service facility to the well head or may be connected to a cable which is transported to the well head where the cable is connected with a winch which in turn pulls the coiled tubing through the flow line to the well head.

9 Claims, 10 Drawing Figures

WELL FLOW SYSTEM AND METHOD

This invention relates to well systems and methods of installation and operation and more particularly relates to a system and methods of installation and operation for gas lift production of remotely located wells such as offshore wells.

When operating wells such as oil wells the natural formation pressures caused by such forces as water drive and gas drive in the earth, formations around a well often become depleted to the extent that it is necessary to supplement such pressures for continued oil production. Such supplemental production pressure is obtained by techniques which include "gas lift". Gas lift production involves the introduction of gas under pressure into the production tubing of a well where the gas enters the oil in the tubing assisting in lifting the oil to the surface. In order to produce a well by gas lift it is necessary to equip the well with the required injection gas facilities which include a conduit extending from a source of gas under pressure to the well head where the lift gas is forced into the annulus of the well through which the lift gas flows downwardly to a gas lift valve which admits the lift gas from the annulus to the production tubing. Unless a flow conductor has been previously provided it is necessary to run a suitable pipeline to the well head in order to supply the well with the desired lift gas. In the case of offshore well heads which may be located on a platform a great distance from the shoreline or from a gathering station which often is another platform a substantial distance from the well head, which is a major project requiring the facilities and the personnel such as a pipe laying ship or barge and operators normally employed in initially laying the flow lines and the like. No known apparatus and methods for equiping and operating offshore wells by gas lift techniques are available other than the use of separate independent pipelines for the required lift gas.

It is, therefore, a principal object of the present invention to provide new and improved apparatus and methods of installation and operation for the production of wells, especially offshore wells, by gas lift techniques.

It is another object of the invention to provide apparatus for the production of offshore wells by gas lift which includes a section of continuous tubing between a service facility and an offshore well head installed within the flow line from the service facility to the well head to conduct lift gas to the well head while the flow line simultaneously communicates well production from the well head to the service facility in the annular space in the flow line around the coiled tubing.

It is another object of the invention to provide a method for installing a section of coiled tubing in a flow line for gas lift purposes including transporting the coiled tubing from the service facility to the well head platform by means of pumpdown pistons which are connected directly to the free end of the coiled tubing to pull the coiled tubing or alternatively, are connected with a cable which is in turn coupled with the coiled tubing free end.

It is another object of the invention to provide for two-way flow with a well through a single flow line.

It is another object of the invention to provide a method of producing an offshore well by gas lift which includes the steps of forcing lift gas from a service facility through section of coiled tubing internally of the flow line to the well head simultaneously producing the well through the flow line in the annulus within the flow line around the gas lift coiled tubing.

In accordance with the invention there is provided a system for producing an offshore oil well by gas lift which includes a well having production tubing including a gas lift valve connected with a well head provided with fittings for communication with the production tubing and with the annulus in the well around the tubing, a service facility located remotely from the well head, a flow line connected with the production tubing at the well head and extending to the service facility, a section of coiled tubing within the flow line extending through the flow line to the well head from the service facility and connected at the well head into the annulus of the well for communicating lift gas from the service facility to the annulus of the well, means for supplying lift gas under pressure into the coiled tubing at the service facility, and the coiled tubing being disposed in spaced relation along and internally of the flow line so that the outisde of the coiled tubing and the inner wall of th flow line define an annular passage along the flow line for well production to move from the well head to service facility simultaneously with the supply of lift gas through the coiled tubing to the well head. The coiled tubing is installed from the service facility to the well head by transporting the free end of the coiled tubing from the service facility to the well head through the flow line by means of pumpdown pistons which are coupled either directly with the free end of the coiled tubing or alternatively, connected with a cable which is secured to the free end of the coiled tubing to pull the coiled tubing from the service facility along the flow line to the well head. The well system is operated by forcing lift gas through the coiled tubing to the well head while simultaneously flowing well production fluids from the well head to the annular space in the flow line around the coiled tubing to the service facility.

The foregoing objects and advantages of the invention will be apparent from the following detailed description of preferred embodiments thereof taken in conjunction with the accompaning drawings wherein.

Figure 1:
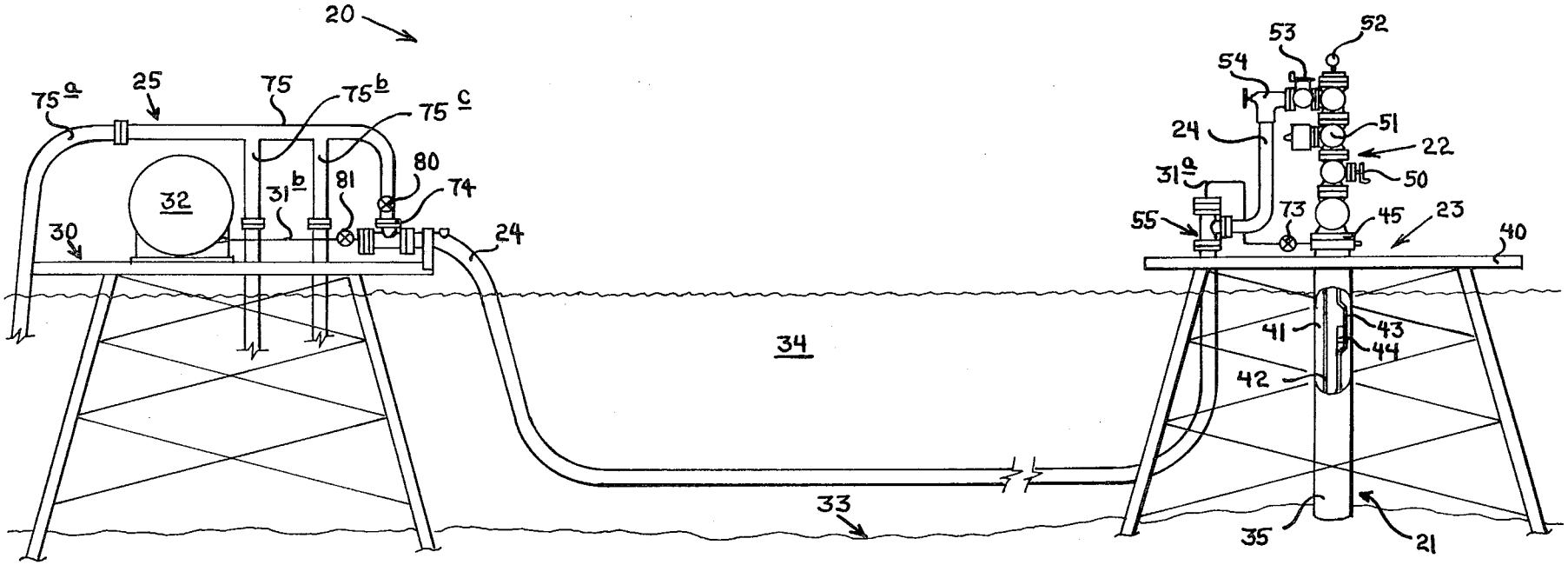
FIG. 1 is a schematic side view in elevation of a gas lift system for producing a well in accordance with the invention.

Referring to FIG. 1, a well system 20 embodying the features of the invention for gas lift production of well fluids includes a well 21 having a well head christmas tree 22 supported on a platform 23 and connected by means of a flow line 24 with a service facility 25 mounted on a platform 30. A section of continuous coiled tubing 31 is connected from a source of lift gas pressure 32 through the flow line 24 to the well head 22 where the coiled tubing connects to the annulus of the well 21. As discussed in more detail hereinafter, lift gas for producing the well 21 flows from the service facility to the well through the coiled tubing 31 while well fluids are produced from the well into the flow line 24 through which the well fluids flow to the service facility within the flow line around the coiled tubing in the annular space defined within the flow line between the inner wall of the flow line and the outer wall of the section of coiled tubing.

The platform 23 rests on the bed 33 of a body of water 34. A casing 35 of the well 21 extends from the deck 40 of the platfoem into the well defining an annular space 41 in the well around a string of production tubing 42 which is connected from the well head christmas tree 22 down to the producing formation, not shown, in the bed 33 which communicates with the production tubing. The production tubing includes a gas lift mandrel 43 which supports a gas lift valve 44 for controlling the admission of lift gas from the annulus 41 in the well tubing into the production tubing 42 to assist in lifting production fluids to the well head. Typical gas lift systems including gas lift mandrels and valves are manufactured and distributed by Otis Engineering Corporation as illustrated and described at pages 4037–4057 of the 1974–75 edition of the Composite Catalog of Oil Field Equipment Services published by World Oil, Houston, Tex. The christmas tree 22 includes a suitable standard fitting 45 which provides for communication of the coiled tubing section 31 into the annulus 41 and connection of the production fluid flow passages through the christmas tree into the production tubing string 42. The christmas tree also includes such standard components as a gate valve 50 which is manually operable to control communication with production tubing, a surface safety valve 51 which has suitable standard pressure controlled safety devices, a pressure gauge 52, and valves 53 and 54 through which the flow line 24 is connected into the christmas tree.

Figure 6:
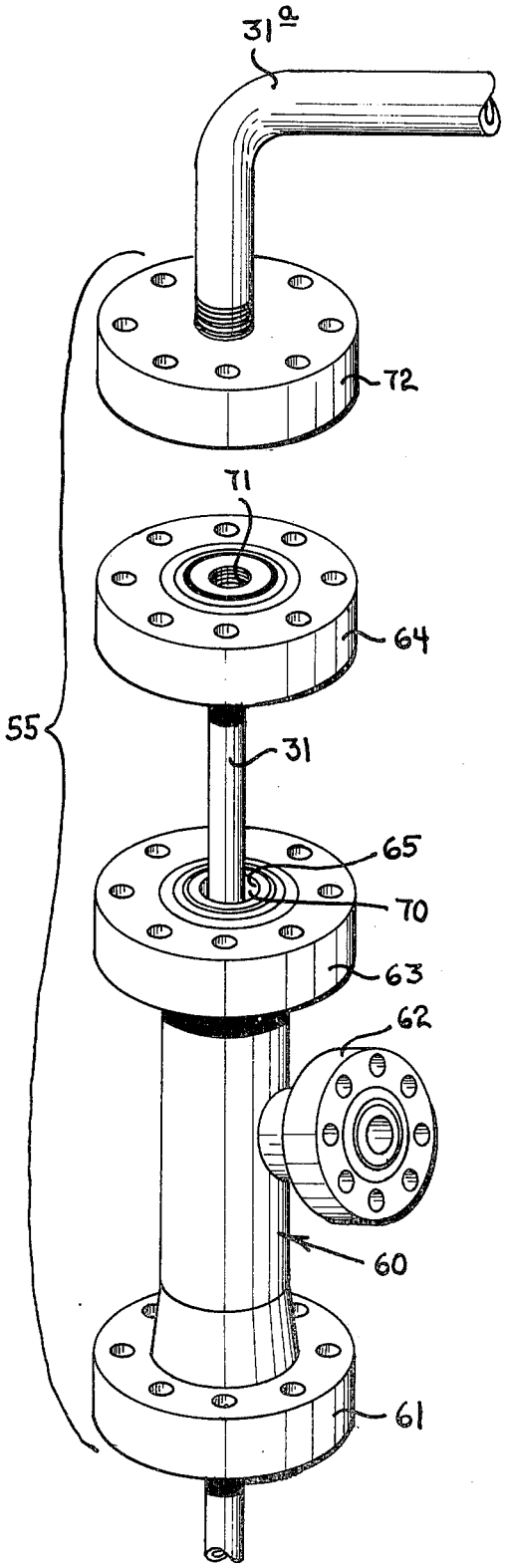
FIG. 6 is an exploded view in perspective of the fitting employed on the well head in the system of the invention for communicating the flow line and the coiled tubing with the well production tubing and the well annulus for gas lift of production fluids.

The flow line 24 and the coiled tubing section 31 for lift gas are coupled with the well head christmas tree through a fitting 55 which is shown in detail in FIG. 6. Referring to FIG. 6, the fitting 55 includes a flanged spool 60 which has a lower flange 61 connectible with the upper end of the flow line 24 on the platform 40 and provided with a side flanged outlet 62 which connects with the short section of the flow line 24 extending from the fitting 55 to the valve 54 on the christmas tree. The spool-shaped coupling 60 has an upper flange 63 on which is connected a blind flange 64. The fitting 60 has a bore 65 which is larger than the outside diameter of the coiled tubing 31 defining an annulus 70 in the fitting 60 around the coiled tubing. The side connection 62 opens into the annulus 70 around the coiled tubing for communication of production fluids into the flow line around the coiled tubing. The blind flange 64 has a smaller internally threaded bore 71 for connection with the upper end of the coiled tubing 31. The blind flange 64 closes off the upper end of the annulus 70 within the spool coupling 60 around the coiled tubing while permitting communication of the coiled tubing through the blind flange. A flange 72 connects on the blind flange 64 and is coupled with a short section of conduit 31*a* which communicates through the blind flange 64 with the coiled tubing section 31. The conduit section 31*a* connects through a valve 73 into the fitting 45 of the well head christmas tree for communicating lift gas into the annulus 41 of the well 21. The fitting 55 allows well production into the flow line 24 through the side connection 62 and the annulus 70 around the coiled tubing section 31 while simultaneously permitting flow of lift gas to the well in the coiled tubing 31. The coiled tubing section 31 extends through the flow line 24 to the service facility 25 on the platform 30. The coiled tubing is disposed within the flow line in spaced relation thereby defining in the flow line a central flow passage for lift gas separate from an annular flow passage for well production fluids around the coiled tubing section within the flow line.

At the platform 30 the flow line 24 connects with a T-coupling 74 which may be constructed with exactly the same features as the fitting 55. A manifold 75 is connected through a valve 80 with the fitting 74. The manifold 75 includes branch lines 75*a*, 75*b*, and 75*c* which all lead to similar satellite wells such as the well 21, not shown, all of which are serviced from the facility 25. It will be evident that the service facility 25 may be provided with oil storage facilities, not shown, or may be connected by a pipeline, not shown, to a shore facility. The service facility includes the pressure source 32 for lift gas which may be a suitable compressor connected with a source of supply of lift gas, not shown, and capable of increasing the pressure of such lift gas to an adequate level for delivery to the well 21 and high enough for admission into the production string 42 to aid in raising in well fluids in the production string. The compressor 32 is connected by a conduit section 31*b* through a valve 81 into the flange 72 of the fitting 74. Thus, the compressor 32 delivers lift gas through the pipe section 31*b* and the fitting 74 into the coiled tubing section 31 disposed through the flow line 24 extending to the well head christmas tree 22 of the well 21 at the platform 23. Thus, lift gas may flow from the service facility 25 to the well head while production fluids from the well head flow in the opposite direction from the well head back to the service facility.

The coiled tubing 31 which is used to direct the lift gas from the service facility to the well head is preferably continuous tubing which usually is formed of soft steel and has a $\frac{3}{4}$ to 1 inch outside diameter. The tubing is sufficiently flexible to be wound and stored on the reel and has been commonly used for various well services such as paraffin removal, treatment of the various earth formations around the well, washing sand within a well bore, well stimulation of various types, and related well treatment processes. Thus, the coiled tubing is readily manipulated to be injected into a well and transported along a well bore. Thus, coiled tubing is particularly adaptable to installation and operation in accordance with the method and apparatus of the present invention in that it may be installed between the service facility 25 and the remotely located well 21 without the necessity of laying additional conduit means along the water between the two platforms.

Figure 2:
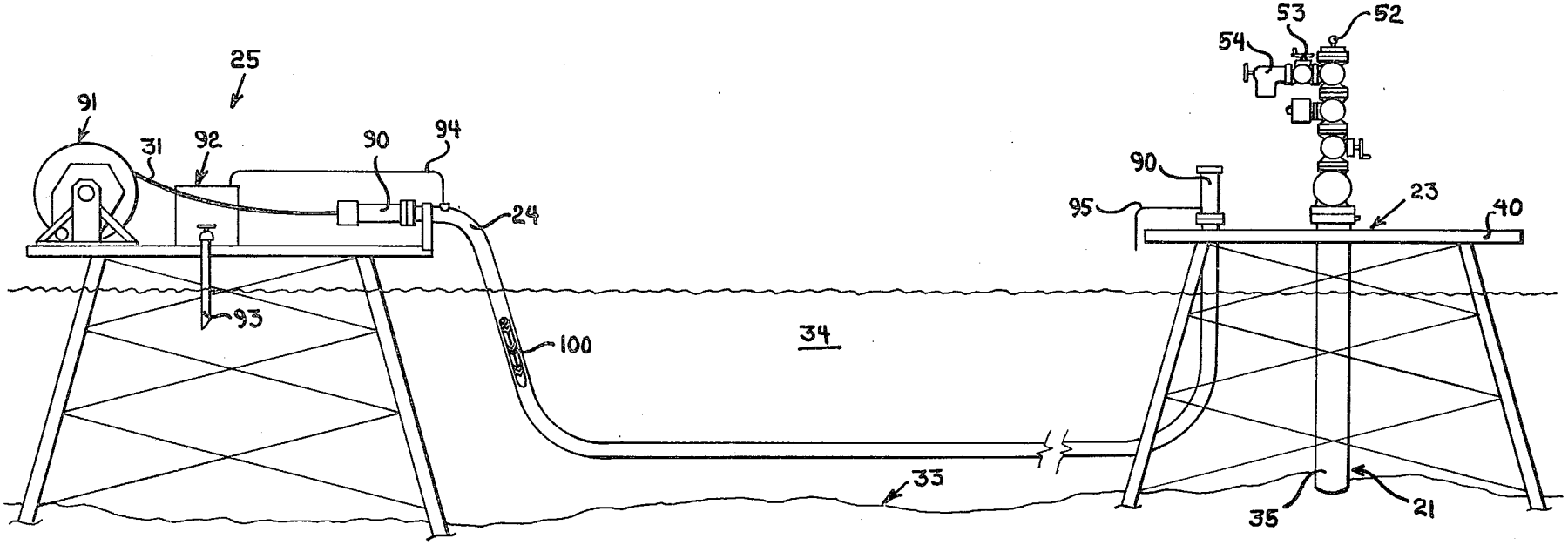
FIG. 2 is a schematic side view in elevation similar to FIG. 1 illustrating the installation of the coiled tubing by means of pumpdown pistons.
Figure 10:
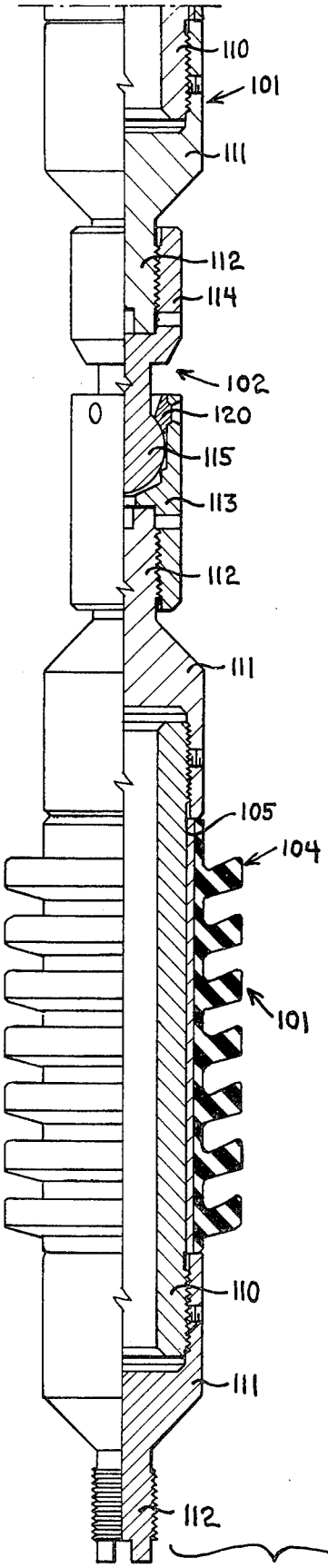
FIG. 10 is a fragmentary longitudinal view in section of a pumpdown piston and the coupling between the piston and another pumpdown piston of the same design.
Figure 9:
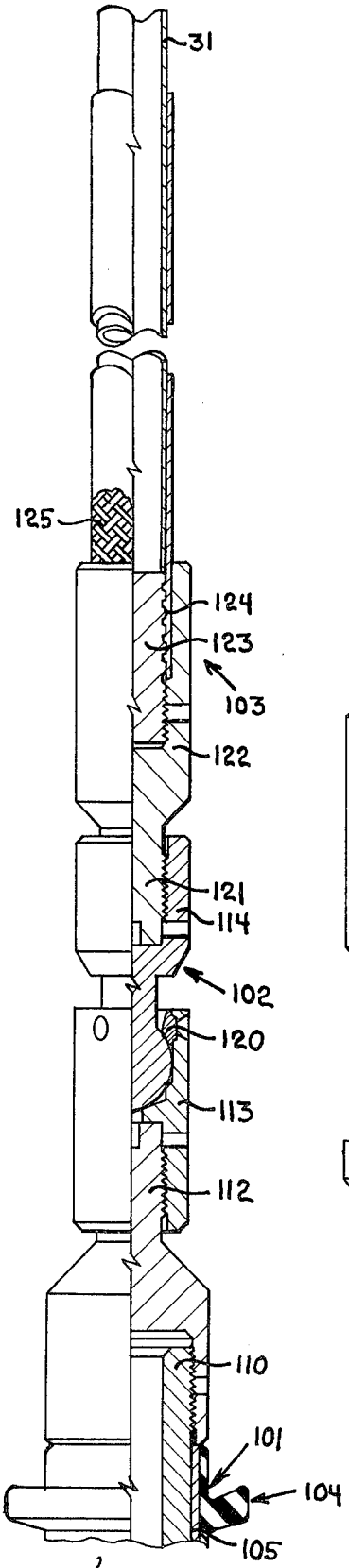
FIG. 9 is another arrangement for the coupling of a pumpdown piston with the end of a section of coiled tubing.

One method of installing the coiled tubing 31 in the flow line 24 is illustrated in FIG. 2 which schematically shows an interim step in the technique of using pumpdown pistons to transport the coiled tubing through the flow line. The tubing is moved through the flow line by use of a pumpdown piston locomotive train coupled to the leading free end of the coiled tubing section installed in the flow line as illustrated in FIGS. 9 and 10. For purposes of carrying out the installation process represented in FIG. 2 the opposite ends of the flow line 24 at the service facility 25 and at the platform 23 are equipped with a suitable lubricator or stuffing box 90 which is designed to hold pressure in the flow line while allowing the coiled tubing string to pass into and out of the flow line ends in a sealed relationship. Suitable lubricators operable for such a function are illustrated at page 3983 of the Catalog of Oil Equipment and Services, supra, and in U.S. Pat. No. 3,182,877 issued May 11, 1965 to D. T. Slator et al entitled APPARATUS FOR FEEDING TUBING OR OTHER OBJECTS. A storage reel 91 for the coiled tubing 31 is mounted on the platform 30. A pump 92 with a seawater intake 93 is also mounted on the platform with the discharge of the pump connected through a line 94 into the flow line 24 downstream of the lubricator 90 at the input end of the flow line at the platform. The pump 92 is used to introduce a displacing liquid such as seawater into the flow line under sufficient pressure to displace the locomotive train through the flow line. The lubricator 90 at the well platform 23 is equipped with a discharge conduit 95 to allow the fluid in the flow line 24 in advance of the locomotive train to be displaced from the flow line as the train moves through the line.

Referring to FIGS. 9 and 10 a locomotive train 100 for pulling the coiled tubing through the flow line includes locomotive unit 101 interconnected by a coupler assembly 102 and secured with the coiled tubing 31 by means of a pulling head 103. Each of the locomotives 101 is a suitable available pumpable seal unit of the type manufactured by Otis Engineering Corporation and illustrated and described at pages 4069–4080 of the Composite Catalog of Oil Field Equipment Services, supra. Each of the locomotive units 101 includes an annular finned seal 104 made of rubber or a similar flexible material mounted on a sleeve 105 secured on a tubular body 110. Head members 111 are threaded on opposite end portions of the body 110 each provided with a reduced threaded end portion 112 for interconnection of the locomotives and for connecting coupling assemblies such as the pulling head 103 and the couplers 102 with the locomotives. The fins on the annular seal 104 of the locomotives are adapted to engage the inner wall surface of a flow conductor so that a pressure differential may be imposed across the locomotive to displace the locomotive along the flow conductor. The fins may be designed for fluid bypass above a predetermined pressure differential at which the fins will fold forward to allow fluid to bypass for continued circulation of the fluid under certain conditions which will minimize damage in the event that the locomotive is jammed or lodged along the flow conductor. Each of the couplers 102 is essentially a ball and socket assembly having a first body member 113 threaded on the pin portion 112 of the locomotive head 111 and a second body member 114 provided with a ball portion 115. The ball 115 is held in the body 113 by a retainer ring 120 which allows the ball sufficient lateral movement to permit tandem connected locomotives to traverse curves along the flow conductor. The pulling head 103 has a reduced threaded pin portion 121 connected with the body 114 of the coupler 102 and an internally threaded body portion 122 which is threaded on an end plug 123. The plug 123 has external annular ridges 124 which are internally spaced within a smooth wall portion of the bore of the body 122 for capturing and holding a flexible wire mesh sleeve 125 fitted around an end portion of the coiled tubing 31. The sleeve 125 is a suitable standard contractible coupling device which reduces in diameter sufficiently when placed under tension to securely grip the outer wall surface of the coiled tubing 31 so that the pulling head 103 may apply sufficient force to the coiled tubing to pull the tubing along the flow line.

In the first step in the method represented in FIG. 2 for installing the coiled tubing 31 in the flow line 24 the locomotive train 100 is placed in the lubricator 90 by disassemblying the lubricator to the extent necessary for positioning the tain within the lubricator. The end portion of the coiled tubing secton 31 is inserted through the stuffing box portion of the lubricator and connected by means of the pulling head 103 with the locomotive train. The train is positioned downstream of the inlet from the line 94 so that displacing fluid pressure may be applied behind the train. The pump 92 is then employed to force displacing fluid through the line 94 into the flow line 24 to force the locomotive 100 along the flow line. The locomotive is then pumped pulling the end of the coiled tubing 31 through the flow line to the lubricator 90 at the well platform 23. The fluid in the line in advance of the locomotive is displaced out of the flow line through the outlet 95 back into th seawater. As previously indicated, this displacing fluid may be seawater taken in through the intake 93 at the pump 92 and discharged subsequently back into the sea. When the locomotive train arrives at the well platform the lubricator 90 at the platform is disassembled to the extent necessary to retrieve the locomotive and to reach the end of the coiled tubing section. The flow line and the coiled tubing section are then connected with the well head christmas tree 22 in the arrangement illustrated in FIG. 1 so that the well may be produced by gas lift utilizing the apparatus shown on the service facility 25 for pumping lift gas from the service facility to the well.

Figure 7:
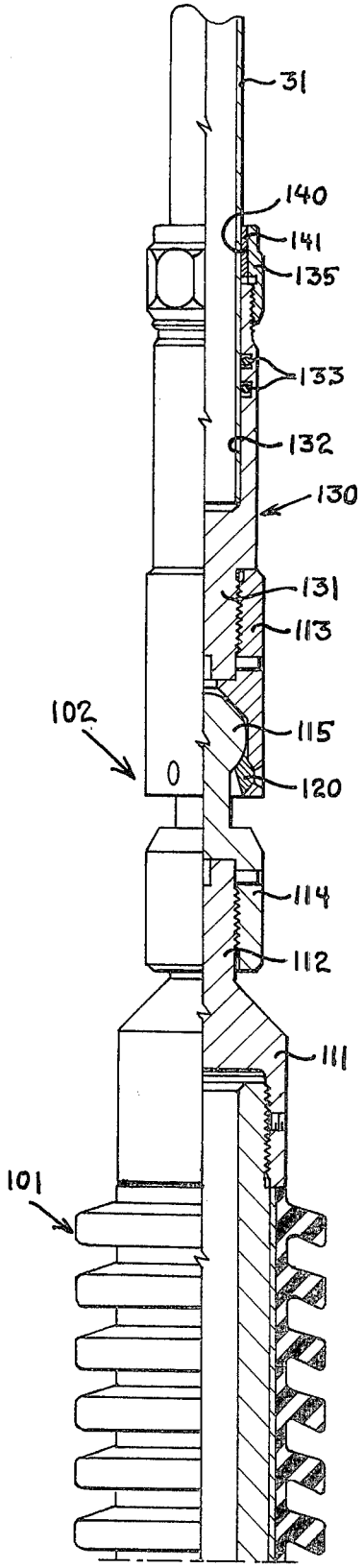
FIG. 7 is a fragmentary longitudinal view in section and elevation of one arrangement for coupling a pumpdown piston with a section of coiled tubing.

FIG. 7 illustrates an alternate arrangement for coupling the locomotive 100 with the coiled tubing 31. The arrangement shown in FIG. 7 includes the same locomotive 101 and coupler 102 as illustrated and described in connection with FIGS. 9 and 10. As shown in FIG. 7 a pulling head 130 having a threaded pin portion 131 is connected with the coupler 102. The head 130 has a smooth blind bore 132 which receives the end portion of the coiled tubing 31. Ring seals 133 are disposed in internal annular recesses around the bore 132 to seal with the coiled tubing end portion. A nipple 135 is threaded on the end of the pulling head 130. The nipple is provided with a convergent bore porton 140 which is larger than the outside diameter of the coiled tubing 31. A retainer 141 which may be a split ring or several arcuate segments is clamped between the nipple 135 and the coiled tubing 31 to grip the tubing surface for interlocking the tubing with the pulling head 130. The coupling arrangement illustrated in FIG. 7 may be used in place of the sleeve 125 shown in FIG. 9.

Figure 3:
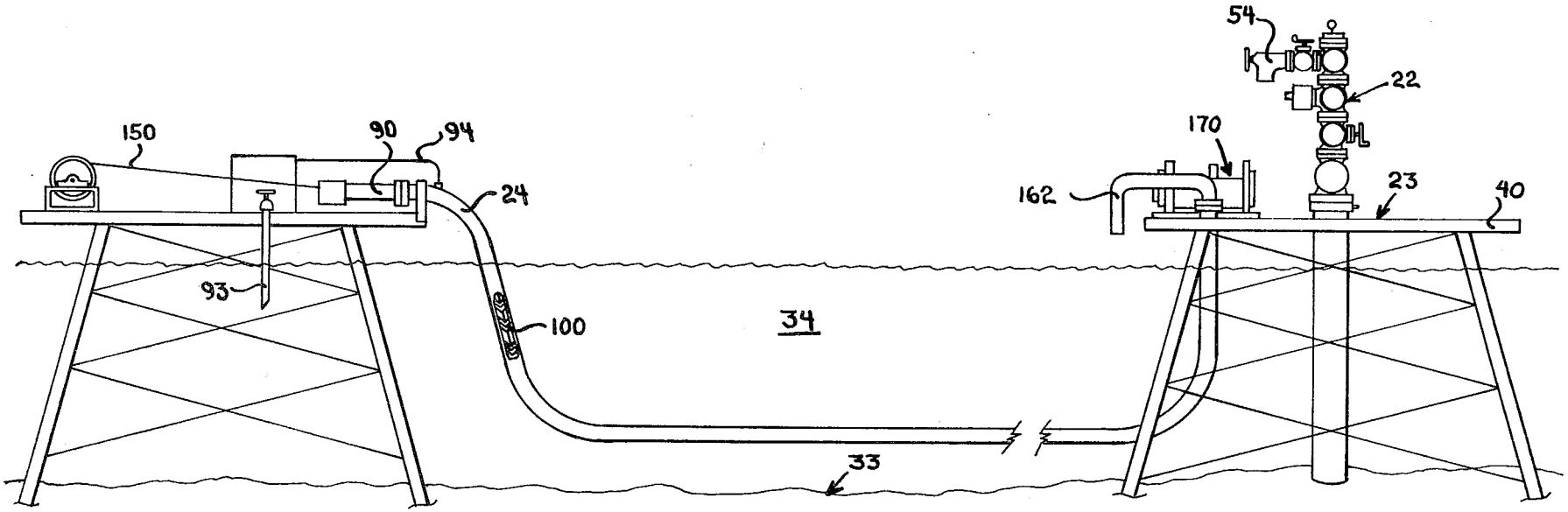
FIG. 3 is a schematic side view in elevation similar to FIG. 1 showing a first step in a procedure for installing the coiled tubing using a cable leader transported by pumpdown pistons.
Figure 4:
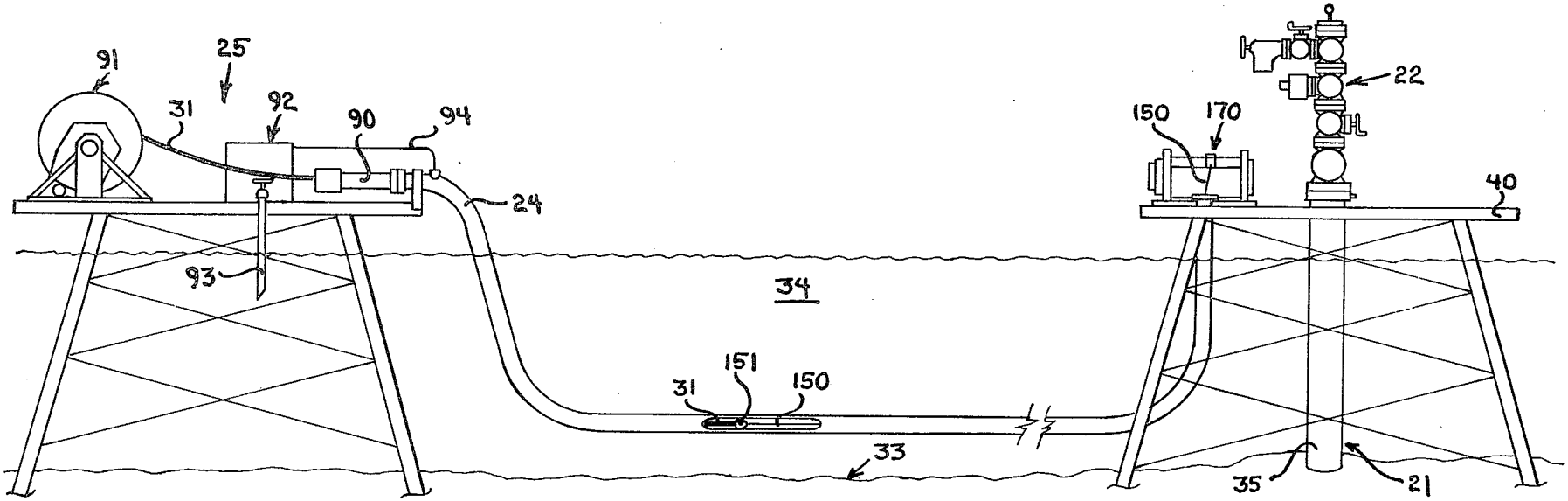
FIG. 4 is a schematic side view in elevation of a subsequent step in the procedure of installing the coiled tubing as shown in FIG. 3 wherein the cable is being used to transport the coiled tubing.

FIG. 3 illustrates a still further method of transporting the coiled tubing section 31 through the flow line 24 utilizing a wire line leader 150 which is first run from the service facility 25 to the well platform 23. A subsequent step of the method of FIG. 3 is illustrated in FIG. 4. The wire line 150 is connected with the tubing 31 by a pulling head assembly 151 which has a tubular body portion 152 provided with a smooth bore section 153 and an end internally threaded bore section 154. An end porton of the wire line 150 is held within the body 152 by the interaction of a tapered member 155 which fits within a member 160 having a tapered internal bore. The end portion of the wire line 150 is partially wrapped around the member 155 so that when tension is applied to the wire line the pulling force toward the tapered bore of the member 160 holds the end portion of the wire line tightly within the smooth bore 153 of the body 152. The body 152 is connected with a pulling head 132 which is threaded into the bore 154 holding the coiled tubing section 131 as described in connection with FIG. 7 utilizing the same components as shown in FIG. 7. The other forward end of the wire line 150, not shown, is connected with an identical pulling head 151 which is then secured with a locomotive tool train 100 by threading the bore 154 of the body 152 on the pin porton 112 of the upstream end of the locomotive 101 in the tool train adjacent to the wire line pulling head.

Figure 8:
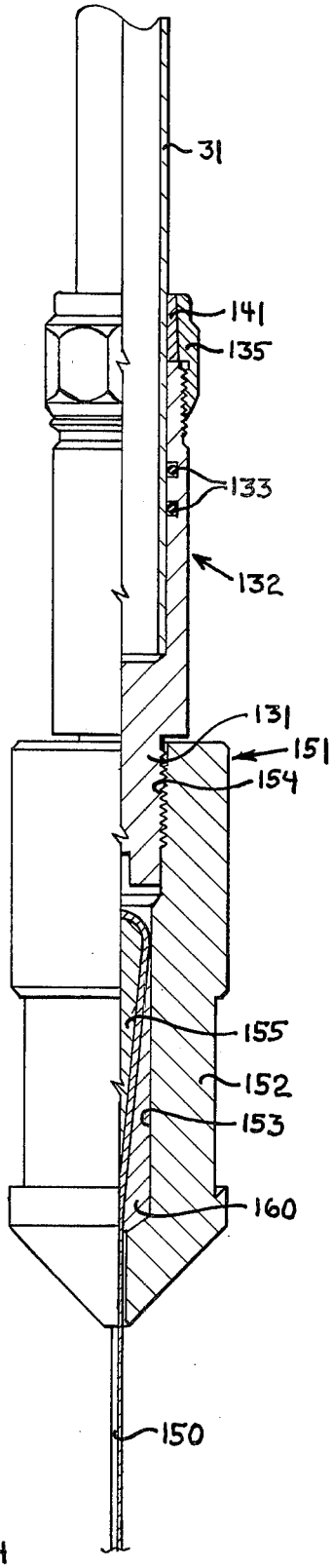
FIG. 8 is a longitudinal fragmentary view in section and elevation of a fitting for connection of a cable with a section of coiled tubing.

In the operation of the coiled tubing installation method represented in FIGS. 3 and 4 the wire line 150 is first transported through the flow line 24 by installing the locomotive train 100 coupled with the wire line by means of the head 151. The tool train is pumped through the flow line 24 to the platform 23 with fluid in th flow line being displaced back into the sea through discharge outlet 162 which is temporarily connected with the end of the flow line at the platform 23. When the tool train reaches the platform 23 at the discharge 162 the discharge is removed, the tool train is pulled from the flow line and disconnected from the wire line and the wire line is secured with a winch 170 on the well platform 23 as represented in FIG. 4. The downstream end of the wire line at the service facility 25 is connected with the coiled tubing from the reel 91 using the apparatus illustrated in FIG. 8. The winch 170 is then used to pull the wire line through the flow line 24 for transporting the coiled tubing 31 from the service facility to the well head platform. After the wire line has pulled the coiled tubing completely through the flow line 24 to the platform 23, the wire line and pulling head assembly 151 are disconnected from the coiled tubing 31 and the coiled tubing and the flow line are connected with the well head christmas tree as illustrated in FIG. 1 for practice of the gas lift method of production.

Figure 5:
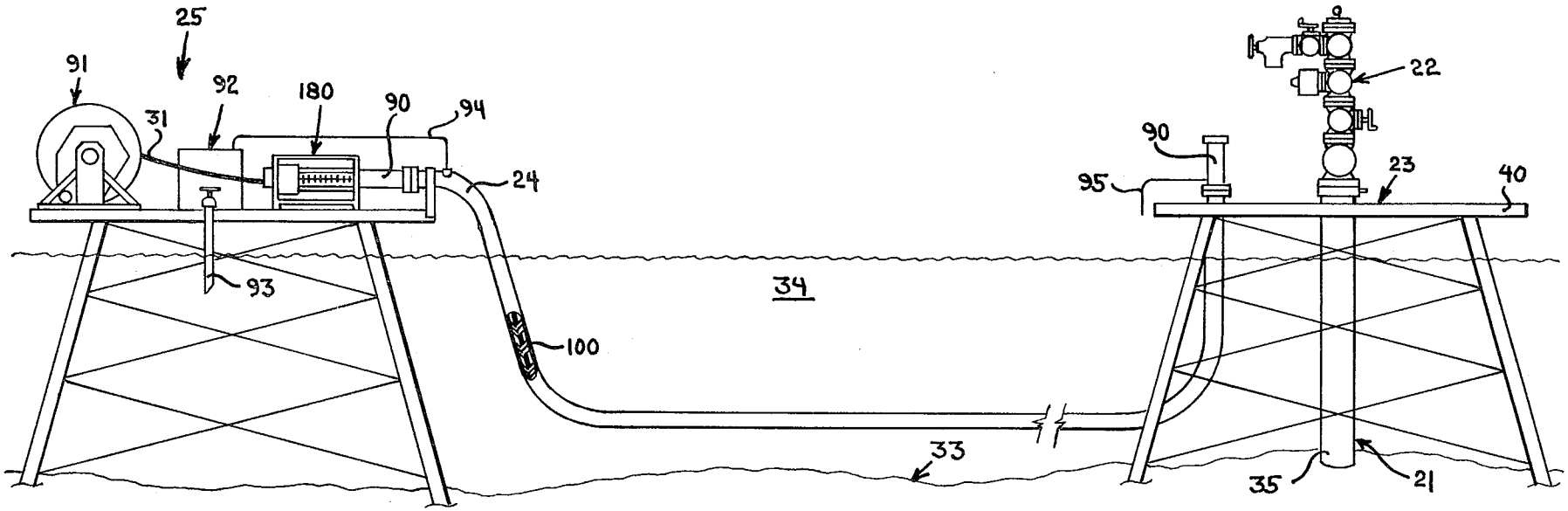
FIG. 5 is a schematic side view in elevation similar to FIGS. 1–4 showing use of a tubing injector in association with pumpdown pistons for transporting the coiled tubing through the flow line from the service facilities to the well platform.

A still further method of installing the coiled tubing section 31 in the flow line 24 is illustrated in FIG. 5 which includes the use of a tubing feed device 180 for feeding the coiled tubing 31 into the flow line 24 through the stuffing box and lubricator 90 while simultaneously transporting the tubing by means of the locomotive train 100. The service facility 25 and the well head platform 23 are equipped as described in connection with FIG. 2 with the addition of the feed apparatus 180. A suitable coiled tubing feed apparatus is illustrated and fully described in U.S. Pat. No. 3,182,877, supra, which shows the apparatus A for forcing the coiled tubing through the stuffing box and lubricator 90 into the flow line 24. The combined forces applied by pulling the leading end of the coiled tubing 31 with the locomotive train 100 and the pushing force applied to the coiled tubing by the apparatus 180 moves the coiled tubing through the flow line from the service facility to the well head platform. The leading end of the coiled tubing is, of course, connected as previously described and illustrarted with the locomotive train 100. Also, the pumping operation is carried out in the same identical manner as previously described. When the end of the coiled tubing reaches the platform 23 the tubing and the flow line are connected with the well head christmas tree 22 as shown and described in connection with FIG. 1.

The selection of the particular method and apparatus for transporting the coiled tubing through the flow line will depend upon the particular conditions which exist at the well installation involved. Factors which can affect the selection are the distance between the service facility and the well head platform, the turns and curvature of the turns in the flow line 24, and related matters which may make a particular installation more difficult or more easily accomplished. Under certain conditions such as where more severe turns are used in the flow line, the use of the wire line leader may cause some cutting along the inner surface of the flow line which would not occur where the locomotive train is coupled directly with the coiled tubing for transporting the tubing solely with the force of the locomotive train as shown in FIG. 2 or with the additional force applied by the feed apparatus 180 as illustrated and described in connection with FIG. 5. It will be recognized that several satellite wells may readily be serviced from a single facility 25 and thus, coiled tubing may be connected from the service faclity to any one or all of the satellite wells using any one of the described and illustrated procedures for transporting the coiled tubing.

After the coiled tubing is fully installed as discussed and the well is connected as illustrated in FIG. 1, the well is produced by gas lift by gas lift which is particularly characterized by the pumping of lift gas through the flow line within the coiled tubing 30 from the service facility to the well head tree 22 and the simultaneous flow of production fluid from the well head back to the service facility within the same flow line 24 in the annular space in the flow line around the coiled tubing. Thus, the equipping and the production of the well is accomplished entirely through the flow line without the necessity of the additional expense and time requried to lay separate flow conductors for the lift gas.

It will be recognized that while a side-pocket type mandrel 43 as illustated in FIG. 1 for supporting the gas lift valve 44 along the production string 42, other forms of gas lift valves may be used. For example, an annular gas lift valve which forms an integral part of the production string is illustrated and described in U.S. Pat. No. 3,426,786 issued to Carlos R. Canalizo, Feb. 11, 1969, assigned to Otis Engineering Corporation, entitled GAS LIFT VALVE.

While the methods and apparatus of the invention have been described primarily in terms of use of the well system for gas lift, it will be recognized that other well procedures which require communication with satellite wells may be carried out between the service facility and the well platforms through the coiled tubing and the flow line. One problem which occurs around the coiled tubing to the service facility, for example, in situations where wells produce high paraffin content fluids there is a tendency for the paraffin to coat the inner wall surface of the flow line as the fluids pass through the line in cold water around the line. The coiled tubing 31 may be disconnected from the well head so that the end of the tubing from the fitting 55 discharges back into the sea and warm sea-water pumped through the coiled tubing for heating the flow line 24 to assist in remelting the paraffin so that it will flow to the servive facility in the flow line along with the well fluids. Also, by suitably interconnecting the production tubing 42 and the well annulus 41 through the christmas tree 22 the coiled tubing may be communicated with the production tubing for carrying out other well servicing methods such as various formation treating and production stimulation techniques.

What is claimed is:

1. A system for two-way flow communication between a well service facility and a remote well including flow means communicating with separate flow passages in said well comprising: a flow line between said service facility and said well; an inner tubing in said flow line extending between said service facility and said well, said inner tubing having an outside diameter less than the inside diameter of said flow line, the outer wall of said inner tubing and the inner wall of said flow line defining a first annular flow passage along said flow line around said inner tubing between said service facility and said well head and said inner tubing defining a second separate flow passage between said service facility and said well head; first flow means at said service facility for communicating with said first annular flow passage along said flow line; second flow means at said service facility for communicating with said second flow passage in said inner tubing; first flow means at said well for communicating said first annular flow passage in said flow line with one of said separate well flow pasages; and second flow means at said well for communicating the other of said separate well flow passages with said second flow passage in said inner tubing.

2. A well system in accordance with claim 1 wherein said first annular flow passage along said flow line is connected at said well and at said service facility for producing well fluids from said well to said service facility; said inner tubing is connected at said well and at said service facility for communicating lift gas from said service facility to said well to assist in production of well fluids from said well through said first annular flow passage back to said service facility; and flow means at said service facility connected with said inner tubing and adapted to be connected with a supply of lift gas.

3. A well system in accordance with claim 2 wherein said inner tubing is connected at said well with the annulus of said well to communicate lift gas through said annulus around a production tubing in said annulus to gas lift valves along said production tubing.

4. A gas lift system for producing remotely located wells comprising: a well head supported on a well; flow conductors connected with said well head defining a central production fluid flow passage in said well and an annular separate flow passage around said central flow passage; a gas lift valve mounted along said central flow passage to admit lift gas from said annular flow passage into said central flow passage; a flow line connected with said well head into said central flow pasage and extending to a remotely located service facility for production of fluids from said well head to said service facility; an inner tubing string in said flow line from said service facility to said well head connected to said well head into said annulus of said well for injecting lift gas from said service facility into said annulus of said well; said inner tubing in said flow line defining a central flow passage along said flow line for flow of lift gas from said service facility to said well head and the outer wall of said inner tubing and the inner wall of said flow line being spaced apart defining an annular flow passage along said flow line around said inner tubing for production fluids flow from said well head to said service facility simultaneously with the flow of lift gas through said inner tubing to said well head; and means at said service facility connected into said inner tubing for supplying lift gas to said inner tubing.

5. A well system in accordance with claim 4 wherein said inner tubing in said flow line is continuous coiled tubing.

6. A well system in accordance with claim 5 wherein said well head is connected with said flow line and said inner tubing through a flow communication fitting comprising a flow coupling having an annular chamber and a side outlet communicating with said chamber opening into said flow line and said chamber being closed at one end thereof by blind flange means having a bore defining a flow passage communicating with said inner tubing and having a fitting extending from said flange connected with said well head and communicating with said inner tubing.

7. A method of gas lift production of a well comprising the steps of: flowing lift gas to said well through a tubing string extending from a supply of lift gas under pressure to said well; and flowing production fluids from said well through a flow line disposed around said tubing string for said lift gas in an annular flow passage in said flow line defined by the inner wall of said flow line and the outer wall of said lift gas tubing.

8. A method in accordance with claim 7 wherein said well is a remote satellite well at an offshore location and said lift gas is transmitted to said satellite well from a service facility through an inner string of coiled tubing installed within a flow line extending from said satellite well to said service facility through which said well fluids are produced from said well to said service facility around said coiled tubing string simultaneously with the transmission of lift gas through said coiled tubing string.

9. A well system for the gas lift production of a satellite well from a service facility spaced therefrom comprising: a well head on said satellite well having means for communication with a central production string and an annular flow space in said well; a production string in said well; gas lift valve means in said production string adapted to admit lift gas from said annulus into said production string; a service facility spaced from said satellite well; a production fluids flow line from said service facility to said satellite well; a continuous coiled tubing string disposed through said flow line from said service facility to said satellite well; said coiled tubing string being spaced within said flow line defining a first central flow passage through said coiled tubing string and defining with said flow line a second annular flow passage within aid flow line around said coiled tubing string; means at said service facility adapted to supply lift gas under pressure connected with said coiled tubing string for flowing lift gas from said service facility to said satellite well; means at said service facility connected with said flow line into said second annular flow passage for receiving well production fluids from said satellite well through said flow line simultaneously with flowing lift gas through said first central flow passage to said satellite well; and flow coupling means at said satellite well between said well head and said flow line and coiled tubing string communicating said first central flow passage in said coiled tubing string with said annular space in said well and said second annular flow passage through said flow line with said production tubing in said well.

* * * * *